US011591123B2

(12) United States Patent
Pieper et al.

(10) Patent No.: US 11,591,123 B2
(45) Date of Patent: Feb. 28, 2023

(54) FILLING DEVICE AND METHOD FOR FILLING BAGS WITH A RESPECTIVE UNSEALED UPPER END

(71) Applicant: Windmöller & Hölscher KG, Lengerich (DE)

(72) Inventors: Jonas Pieper, Lengerich (DE); Oliver Huil, Lengerich (DE); Hans-Ludwig Voss, Lengerich (DE); Ralf Udally, Lengerich (DE)

(73) Assignee: Windmöller & Hölscher KG, Lengerich (DE)

( * ) Notice: Subject to any disclaimer, the term of this patent is extended or adjusted under 35 U.S.C. 154(b) by 105 days.

(21) Appl. No.: 16/970,485

(22) PCT Filed: Feb. 5, 2019

(86) PCT No.: PCT/EP2019/052681
§ 371 (c)(1),
(2) Date: Aug. 17, 2020

(87) PCT Pub. No.: WO2019/158386
PCT Pub. Date: Aug. 22, 2019

(65) Prior Publication Data

US 2020/0369417 A1 Nov. 26, 2020

(30) Foreign Application Priority Data

Feb. 19, 2018 (DE) ..... 102018202499.5
Apr. 25, 2018 (DE) ..... 102018206356.7

(51) Int. Cl.
*B65B 43/30* (2006.01)
*B65B 43/12* (2006.01)
(Continued)

(52) U.S. Cl.
CPC ..... *B65B 43/30* (2013.01); *B65B 43/123* (2013.01); *B65B 39/10* (2013.01); *B65B 43/36* (2013.01);
(Continued)

(58) Field of Classification Search
CPC ..... B65B 1/02; B65B 39/00; B65B 39/10; B65B 43/30; B65B 43/305; B65B 43/123; B65B 43/00; B65B 43/46; B65B 43/465
See application file for complete search history.

(56) References Cited

U.S. PATENT DOCUMENTS 3,948,019 A 4/1976 Doring et al.
4,007,576 A * 2/1977 Metz ..... B29C 65/7891 361/220
(Continued)

FOREIGN PATENT DOCUMENTS

CN 205931448 U 2/2017
DE 1234578 B 2/1967
(Continued)

OTHER PUBLICATIONS

International Preliminary Reporton Patentability for PCT Application No. PCT/EP2019/052681 dated Sep. 3, 2020, 8 pages.

*Primary Examiner* — Chelsea E Stinson
(74) *Attorney, Agent, or Firm* — Peter W. Schroen; Bret E. Field; Bozicevic, Field & Francis LLP

(57) ABSTRACT

The invention relates to a filling device for filling bags with a respective unsealed upper end and at least two layers lying on top of one another. A filling station for filling the bags in characterised in that the filling device comprises at least one layer movement device (30) for moving the at least one layer of the bag relative to the at least one second layer, with
(Continued)

Figure 1:
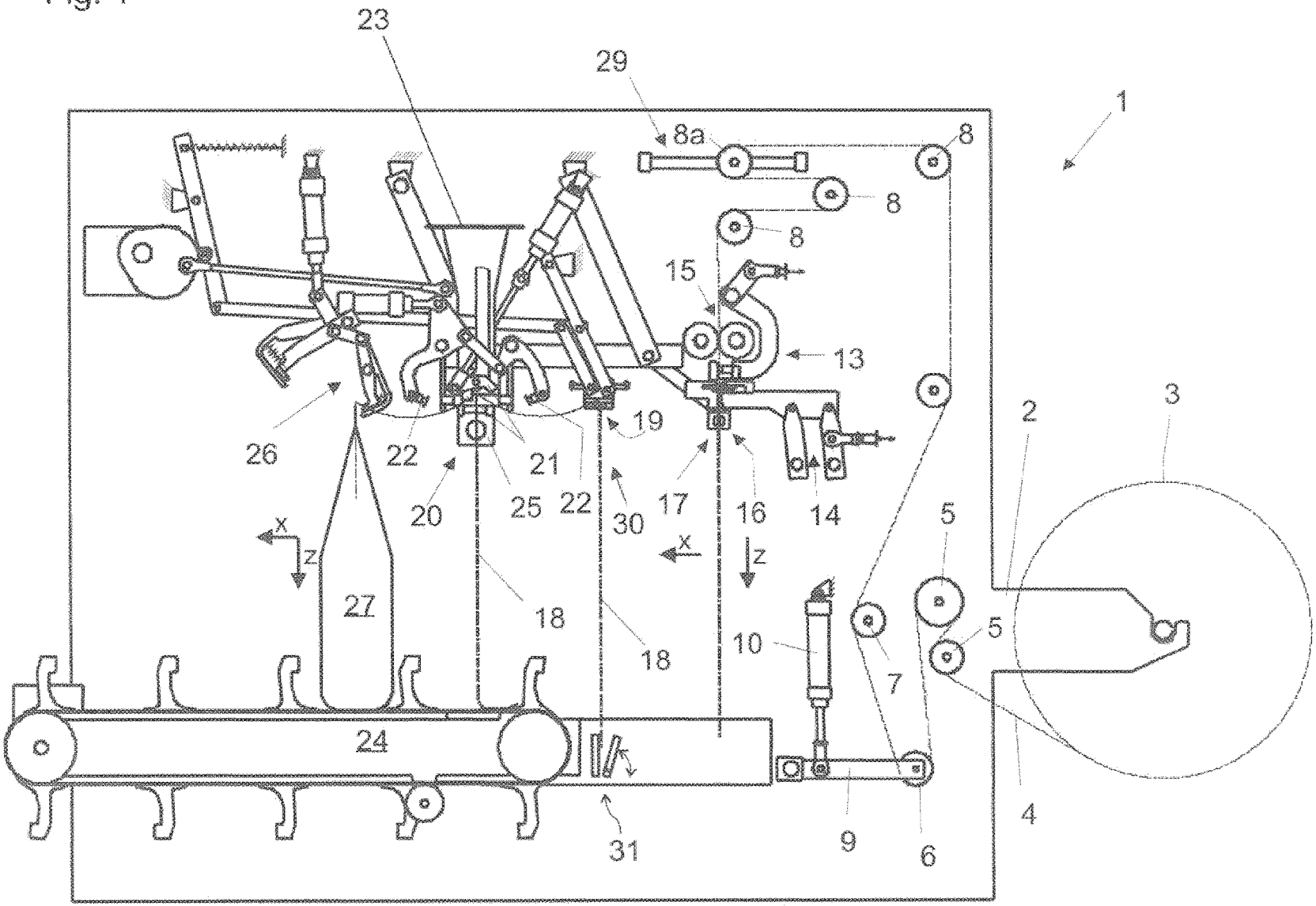

which the layers of the bag can be acted upon, wherein the layer movement device is arranged in front of the filling station.

18 Claims, 3 Drawing Sheets

(51) Int. Cl.
*B65B 39/10* (2006.01)
*B65B 43/36* (2006.01)
*B65B 43/46* (2006.01)

(52) U.S. Cl.
CPC ..... *B65B 43/465* (2013.01); *B65H 2701/191* (2013.01)

(56) References Cited

U.S. PATENT DOCUMENTS 4,873,815 A * 10/1989 Tetenborg ..... B65B 1/22 53/284.7
4,923,064 A 5/1990 Hannon
6,401,439 B1 * 6/2002 Tetenborg ..... B65B 43/465 53/567
6,446,684 B1 * 9/2002 Hiramoto ..... B65B 43/465 141/315
2006/0030470 A1 * 2/2006 Voss ..... B65B 9/13 493/194
2007/0289262 A1 * 12/2007 Koehn ..... B65B 1/02 53/452
2010/0210439 A1 * 8/2010 Goto ..... B65B 61/18 493/200
2013/0036710 A1 * 2/2013 Knoke ..... B65B 9/13 53/134.1
2013/0082474 A1 * 4/2013 Lomerson, Jr. ..... B25J 15/0633 294/186
2016/0122057 A1 * 5/2016 Takahashi ..... B65B 51/10 53/284.7
2020/0354098 A1 * 11/2020 Voss ..... B65B 57/14

FOREIGN PATENT DOCUMENTS

DE 1243578 B 6/1967
DE 1511755 A1 10/1969
DE 2418228 A1 10/1975
DE 7824437 U1 2/1979
DE 3639494 A1 5/1988
DE 10127110 B4 7/2006
DE 19622086 B4 10/2009
DE 102013105603 A1 12/2014
EP 0293615 A2 12/1988
EP 0340315 B1 7/1993
EP 1201539 A1 5/2002
EP 1201539 A1 * 5/2002 ..... B65B 1/02
EP 1201539 A1 * 5/2002 ..... B65B 1/02
EP 1201545 A1 * 5/2002 ..... B65B 43/465
EP 1201545 A1 5/2002
WO WO2008140348 A1 11/2008
WO WO2018129229 A1 7/2018

* cited by examiner

FILLING DEVICE AND METHOD FOR FILLING BAGS WITH A RESPECTIVE UNSEALED UPPER END

The invention relates to a filling device for filling bags with a respective unsealed upper end, a method, and a form fill seal device.

Using filling devices in accordance with the preamble, bags, the upper end of which is unsealed and which are usually transported suspended, are filled from above. The bags are, in that respect, lined, wherein the two layers of material delimit an interior, which provides a volume for a filler. The two layers of material can be connected with one another by way of ordinary lateral edges or by way of side gussets. At the lower end, the bag is sealed. A welded seam covering both layers and, possibly, the side gussets can have been created for this purpose.

In a well-known filling device, an opening section is arranged in a filling device in such a way that no transport is necessary between the opening station and the filling station. A respective means of opening grips each layer in the opening station. The two means of opening subsequently move away from one another and take the respective layer with them, so that the interior of the bag is accessible to the filling station, and thus the filler. It may, in the process, occur that the two layers of material adhere to one another so greatly that opening the bag fails. In the process, one means of opening comes loose from the respective layer when moving. It is thus no longer possible to fill the bag. The reliability of the opening procedure therefore leaves something to be desired. As a result, the performance of the machine, i.e. the number of bags filled per unit of time, is reduced.

The problem to be solved by the present invention is therefore to propose a filling device and a method where the bags are opened, with a greater degree of reliability, prior to being filled.

This problem is solved by all the features of the invention. Possible embodiments of the invention are specified in the dependent claims.

According to the present invention, it is provided for that the filling device comprises at least one layer-moving device for moving said at least one layer of the bag in relation to said at least one second layer, with which it is possible to have an impact upon the layers of the bag, wherein the layer-moving device is arranged in front of the filling station. In that respect, a further transport facility can be provided for, to transport a bag to the filling station, in regard to which the bags can successively be transported from the layer-moving device to the filling station using the transport facility.

By moving the two layers of the bag towards one another, it is accordingly achieved that the adhesion between the two layers is reduced. It is, in that respect, sufficient for the two layers to be moved in relation to one another in the area between the side gussets, in so far as side gussets exist. It is also sufficient if an impact can be achieved at the top end of the bag using the layer-moving device, in regard to which "top end" means a maximum of 10% of the extension of the bag in its longitudinal axis from the upper edge downwards.

If a bag prepared in this way is transported to the filling station and processed on there, the procedure of opening the bag is much more reliable, in comparison to the filling devices forming the prior art.

In a preferred embodiment of the invention, it is envisaged that at least one means of support, to hold a bag in the layer-moving device, is provided for, which remains stationary within the filling device prior to and/or during the time that the layer-moving device is having an impact, or can be moved within the filling device in the longitudinal direction of the bag with a stroke of a maximum of 15 mm, preferably not more than 10 mm. Thus, in order to move the layers in relation to one another, it is preferably not provided for that the means of support moves. Thus, the need for mechanical effort is eliminated. As a rule, the distance from the outer edges of a bag that is held by means of support is slightly less than the nominal bag width, so that, based on said leeway alone, the layers can be moved in relation to one another. It can, alternatively, be provided for that the means of support performs a movement towards the longitudinal axis of the bag, in order to increase the leeway. It is, however, provided for, in that respect, for the movement of the means of support to be less directed towards the longitudinal axis of the bag than the movement of means of support which hold the bag for the purpose of opening it, for instance within the filling station, wherein such means of support can also be moved, within the filling station, towards the longitudinal axis of the bag.

In a further, advantageous embodiment it is provided for that the layer-moving device comprises at least one fluid nozzle, with which a jet of a fluid can be directed at the top of the bag. It is, for example, possible, due to this jet of fluid, to introduce the fluid between the two layers of the bag in the area of the upper edge, and thus reduce the existing adhesive forces. The jet of fluid leads to a movement of the upper edge of the bag, in regard to which the two layers of the top end move slightly away from one another. A small opening often arises in the process, through which the jet of fluid seeps into the inside of the bag, whereby the two layers may be removed even further away from one another.

The fluid is preferably a gas, in particular air, wherein the gas is preferably subject to excess pressure. The excess pressure preferably amounts to between 4 and 8 bar. At this pressure, the effect in accordance with the invention is demonstrably particularly pronounced. A fluid nozzle can, in such a case, be termed an air nozzle. A filling device is frequently already connected to a compressed air system of a workshop, so that the invention can be implemented cost-effectively. The air pressure of such a compressed air system is generally at 6 bar, so that the excess pressure in accordance with the invention is available without any further effort.

It is advantageous if said at least one fluid nozzle is positioned and/or oriented in such a way that the jet of fluid comprises an orientation component towards the longitudinal axis of the bag. In the event of the bag being suspended (i.e. only being subject to the influence of gravity), said orientation component thus runs vertically downwards. In addition, the fluid nozzle is preferably oriented in such a way that at least one part of the jet of fluid is targeted exactly at the upper edge of the bag. In this case, the effect described leads, particularly reliably, to a relative movement of the layers. A fluid nozzle which generates a flat jet of fluid, i.e. the width of which is greater than its thickness, may be provided for. In this case, it is preferable if the fluid nozzle, and thus also the jet of fluid, is arranged in parallel to, and in particular on the plane of, the bag. The fluid nozzle is, however, preferably arranged at a slant to the axis of the bag. Details on the latter can be inferred from the description of the figures. It can, however, also preferably be provided for to guide the jet of fluid, with at least one component, in a direction orthogonal to the plane, which is defined by the bag. In other words, the jet of fluid presses outwardly on one of the two layers. As a result, however, the second layer is moved as well, in regard to which, however, the two layers are shifted in relation to one another.

In an advantageous embodiment of the invention, at least one electrode is provided for, through which the jet of fluid can be energized with an electric current. The electric current applied, which is sufficiently great, leads to atoms or molecules of the fluid giving off electrons, and thereby acquiring an electrical charge. In other words, the jet of fluid is ionized. An ionized jet of fluid may, at least partially, compensate an electrical charge between the layers, and consequently reduce any electrostatic attraction. The outcome is that a bag can once again be opened more reliably than previously.

In a further embodiment, the electrode is arranged downstream from the jet of fluid coming out of the fluid nozzle, and preferably arranged on the latter, or fastened directly to it. Thus, the fluid nozzle and the electrode form a compact unit, which only takes up a small amount of installation space.

It is, furthermore, advantageous if a valve with which the jet of fluid from a source of excess pressure can be conducted through and/or with which the jet of fluid from a source of excess pressure may be interrupted is provided for. In such a case, a fluid thrust may be capable of being generated, or be generated. The top or the upper edge of the bag may be set in a sudden and forceful motion, by said fluid thrust, which assists the process of loosening the two layers from one another, and can thus reduce the adhesion between the layers of the bag. In that respect, the period of time during which the jet of fluid is maintained should preferably be kept brief, preferably less than 1 second, in particular less than 500 milliseconds (msec.). The benefit of such a brief jet of fluid is that, at the most, a fixed quantity of the fluid is transported into the bag. Too great a quantity of fluid might lead to problems during the subsequent filling procedure.

It is, furthermore, advantageous if a transport device for transporting the bag from the layer-moving device to the filling station is provided for, and, in particular, the interior of the bag remains free of tools while the bag is being transported. Thus, a tool that reaches into the interior of the bag, to keep it open while it is being transported to the filling station, can be dispensed with. In particular, said at least two layers of the bag essentially lie on top of one another while the bag is being transported. In that way, it is achieved that the layers of the bag lie on top of one another again, so that, if possible, no fluid remains in the interior of the bag, and no ambient air gets into the interior of the bag, either. As the adhesion of the two layers to one another has already been reduced by the brief movement of the layers in relation to one another, it is possible to reliably reopen the bag prior to filling it.

In an especially preferred embodiment of the invention, it is provided for that the layer-moving device comprises at least one suction device, which engages with the outside of a layer of the bag. In particular, two suction devices may be provided for. It is possible, with such a suction device, to draw the layers of the bag apart, and thus support the introduction of a jet of fluid for reducing the adhesion between the two layers. At least parts of the suction device should, in that respect, preferably be able to be moved away from the original plane of the bag. At least one lever, for example, on which the suction cup is placed, may serve that purpose. It may, however, also be advantageous for the component or components on which the suction cup is placed to remain fixed in relation to one another, at least while the layers are being moved. Thus, the mechanical effort which could be necessary to move the layers of the bag can be minimized.

In that respect, it is preferably provided for that the suction device touches the upper edge of the bag or even overlaps it. In other words, the suction cup is to be positioned as close as possible to the upper edge of the bag, so that the suction cup and the optional jet of fluid can optimally interact. The suction cup is, in particular, to be positioned in a horizontal direction of the plane of the bag in an area, in which the jet of fluid hits the upper edge of the bag.

It is especially preferred if at least one suction device is provided for on each side of the bag, so that both layers can actively be moved away from one another. The suction devices are, in that respect, preferably offset from one another on the plane of the bag, in particular in a horizontal direction of said plane. In this way, it is prevented that the bag is loosened from one of the two suction cups if the two suction cups do not apply equal negative pressure.

Said at least one suction device may, advantageously, be designed as a bellows suction cup. A bellows suction cup is a suction cup which is distinguished by one or more folds. Should said suction cup be applied to an item, in this case a bag, it cannot suck in any more ambient air if negative pressure is applied to the suction cup.

Consequently, the bellows suction cup automatically shortens its length, as the negative pressure ensures that the interior volume likewise experiences a drop in pressure. Said drop in pressure is compensated by the interior volume being reduced, in particular the length being shortened. A shortening of the length, however, leads to the mutual removal of the layers of the bag. The range of movement of a bellows suction cup may, in that regard, be restricted, in particular less than 20 mm, especially less than 10 mm, which, is, however, sufficient to move the layers in relation to one another, and thus to further reduce the adhesive forces. A bellows suction cup is preferably made from an elastomeric material, so that, after releasing the negative pressure, in other words cutting it off from a source of negative pressure, it extends again, in a similar way to a pressure spring, and takes on its original form again. Thus, a bellows suction cup is a cost-effective, easy to handle, means of developing the present invention. In addition, it is advantageous that at least parts of the bellows suction cup remain fixed in the layer-moving device, at least during the period when the movement of the two layers of the bag in relation to one another can be undertaken.

In a further preferred embodiment of the invention, at least one retaining device is provided for, with which the bag can be held in the layer-moving device. This may be an additional retaining device or identical to the retaining device already mentioned above. The retaining device preferably comprises a lever assembly, so that an opening and closing movement is enabled. By means of a retaining device, the bag is held fixed in the layer-moving device, so that the jet of fluid, for example, is also directed precisely at the upper end of the bag. A retaining device may also be advantageous so that a supplying conveyor can still let go of the bag within the layer-moving device before the filling station conveyor grasps the bag.

The retaining device may in particular grasp the bag a few centimeters, at the most 10 cm, preferably a maximum of 5 cm, and especially a maximum of 2 cm, below the upper edge of the bag, in particular directly underneath the suction device. As the retaining device holds the two layers of the bag in such a way that they are compressed, it is possible to prevent too much fluid from entering the interior of the bag, which, in turn, facilitates the subsequent filling of the bag. The retaining device should, however, also grasp the bag at least 5 mm below the upper edge of the bag, in order to enable the layers to move in relation to one another.

It is advantageous if said at least one retaining device is designed to be bar-shaped. In that respect, the contact surface of the retaining device to the bag may extend in a horizontal direction on the plane of the bag. Said direction may also be termed a transverse direction. In that respect, the retaining device extends over a major part of the width of the bag, wherein "major part" is understood to mean over 50%. In order to still make it possibly to reliably open the bag, in spite of this great extension, it may be stipulated that the retaining device includes a gap and/or recess. This is preferably essentially arranged vertically underneath the suction device and/or underneath the place where a jet of fluid hits the upper end of the bag.

In a further advantageous embodiment of the invention, a device for cooling a base-welded seam is provided for in the layer-moving device. In other words, it is advantageous to stipulate a combined layer-moving and base weld cooling station. While the layers of the upper end of the bag are moved in relation to one another, with the devices in accordance with the invention, the lower end is free. It is therefore appropriate to use the time that is need to move the layers at the upper end of the bag for a further stage of processing. This preferably constitutes the cooling of the base-welded seam of the bag. The cooling device preferably comprises at least one cooling jaw, which is preferably arranged within the machine frame rotatably, in relation to the equipment, in contact with at least one of the two layers of the bag. The cooling jaw may, in that respect, extend over the width of the bag. It is, furthermore, advantageous if the cooling jaw has a further fluid, preferably a liquid, flow through it, or is pressurized with the latter. Alternatively or additionally, the cooling device may include blowing nozzles, with which a gas, which is in particular cooled, is released onto the lower welded seam of the bag.

The problem specified above is, moreover, also solved by a method in accordance with the invention. The method of bags with one respective unsealed upper end and at least two superimposed layers, where the filling is carried out at a filling station, is, according to the invention, characterized in that an impact is exerted upon at least one layer of the bag, using at least one layer-moving device, in order to move said layer in relation to said at least one second layer, wherein the layer-moving device is arranged in front of the filling station.

With the method in accordance with the invention, the same benefits are, in that respect, achieved as have already been described above in connection with the filling device in accordance with the invention.

The problem specified is, further, resolved by a form fill seal device in accordance with the invention, which comprises

- a bag-forming device, with which successive sections made of a tube material of tubing, the lower ends of which can each be equipped with a base, can be separated, to form bags that are open at the top:
- a filling device for successively filing a product into the bags;
- a closure, with which the upper openings of the bag can be closed;
- retaining devices, with which the bags can be held within at least one of the aforementioned devices;
- conveyors, with which the bags can be individually placed between the individual devices specified above, and, as per the invention, is distinguished by comprising the filling device as described above.

The same benefits can be achieved with such a form fill seal device as have already been described in connection with a filling device in accordance with the invention. In the form fill seal device in accordance with the invention, each of the bags is created, filled and closed in a separate device, which is often also known as a station, in regard to which, due to the conveyors and retaining devices within the form fill seal device, it is never unguided.

Further benefits, features and details of the invention are apparent from the description below, where various embodiments are explained in detail, making reference to the figures. In that respect, the features mentioned in the claims and description can always be individual, self-contained features essential to the invention or any combinations of features mentioned. In the context of the entire disclosure, features and details which are described in connection with the method in accordance with the invention apply, naturally also in connection with the filling device and/or form fill seal device in accordance with the invention, and vice versa, so that, mutual reference is, or can always be, made to the individual aspects of the invention, in regard to the disclosure. The individual figures show:

FIG. 1 Lateral view of an FFS machine, which comprises the filling unit in accordance with the invention.

Figure 2:
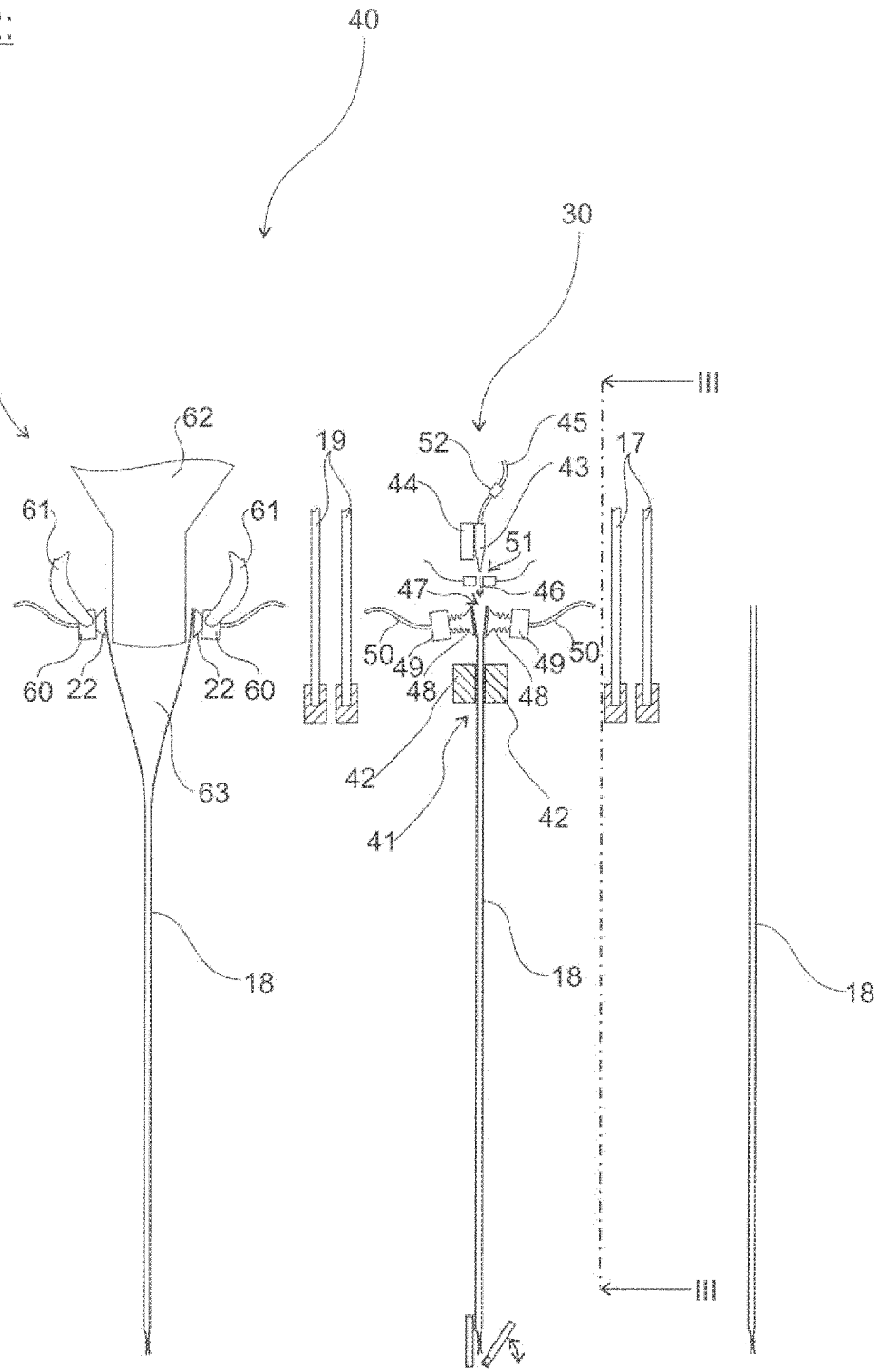
Figure 3:
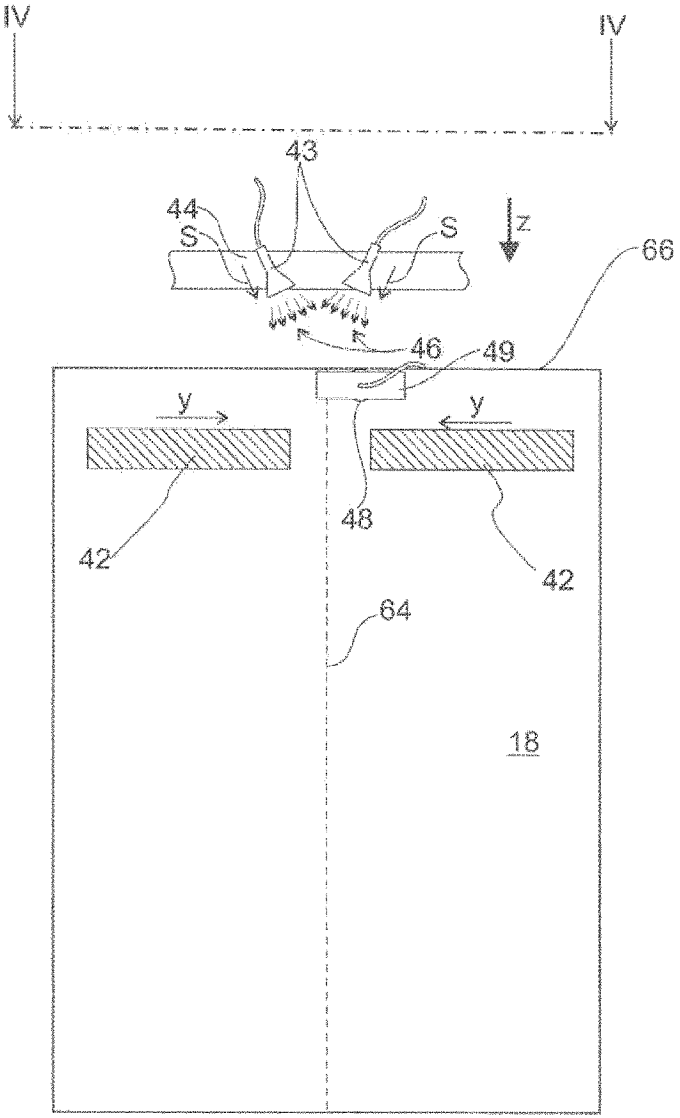

FIG. 2 Detailed perspective of a filling unit in accordance with the invention FIG. 3 The III-III view of FIG. 2

Figure 4:
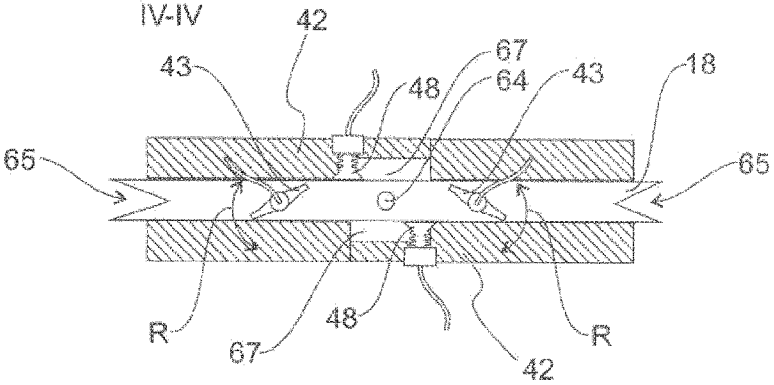

FIG. 4 The IV-IV view of FIG. 3

FIG. 1 shows a form fill seal machine 1, often abbreviated to "FFS machine", which is suitable for forming, filling and closing bags, and in which the filling unit in accordance with the invention can preferably be provided for. Said device 1 comprises a supporting arm 2, on which a winding 3 with a tubular film 4 rests. The tubular film 4 preferably has side gussets not shown in FIG. 1. The feed rolls that can also sometimes be driven, ensure a generally continual winding up of the tubular film 4. The lever 9, subjected to a load through a piston/cylinder unit 10, which supports a deflection roller 6 and is, as a whole, frequently designated a compensating device, and the feed rolls 7 and 8, as well as the pair of feed rollers, ensure, overall, in a known way, that the tubular film 4 continues to be moved intermittently on its further transport route. The feed roll 8*a* is a component of a register device 29, with which the length of the transport route of the tubular film 4 can be adjusted to the format of the subsequent bags 27. For that purpose, the feed roll 8*a* is placed disposably in relation to the device 1. A manual spindle drive, or one operated by an electric motor, that is inherently known, is available to effect the displacement.

Using the pair of feed rollers 15, the tubular film 4 is pushed through the sealing jaws 33 of a transverse welding station 13, and through a transverse cutting station 16. The tools of the transverse welding station 13 and the transverse cutting station 16 can be pushed towards the the tubular film 4 in a way not described further, for instance through a parallelogram arrangement 14, on planes orthogonal to the feed direction of the tubular film 4, and be moved away from the latter. Once the grippers 17 have gripped the tubular film 4, a tubular section 18 within the transverse cutting station 16 is separated from the tubular film 4 above the grippers 17. A transverse weld, which constitutes the base of the tubular section 18 to be formed in the next work cycle of the device 1 is simultaneously applied to the tubular film 4 in the transverse welding station 13, above the cutting edge. Base seams are accordingly generated in the transverse welding station 13. In general, the head or base seams cannot only, even if preferably, be created by way of a transverse weld, but other joining methods, such as gluing, are also conceivable.

The grippers 17 convey the tubular section 18 to a transfer point, where further grippers 19 pick up the tubular section 18 and transport it to a filling station 20.

Said transfer point is the layer-moving device 30 of the filling unit in accordance with the invention. Said layer-moving device 30 may, optionally, interact with a base-cooling device 31. Further details, the construction and the function of the layer-moving device are shown further down in connection with further figures.

At the filling station, the tubular section 18 is handed over to stationary grippers 21, and opened by the suction cups 22, so that the product, which is guided by the filling device 23, can enter the tubular section 18. In that respect, the tubular section 18 has its lower end lying on a conveyor belt 24, so that the tubular section 18 is not excessively burdened along its longitudinal edges during the filling process. Further grippers 25 convey the filled tubular section to the head or base seam welding station 26, where the tubular section 18 is sealed with a head or base welding seam, thus forming a finished bag 27. The tubular section 18 can be closed, in its head section, using another joining method. The finished bag 27 is conducted, by the conveyor belt 24, out of the device 1. In this respect, the bag 27 is usually very much higher (in the "y" direction) than it is wide (in the "x" direction).

FIG. 2 now shows some important features of the filling unit in accordance with the invention in detail. A finished bag can be seen on the far right, which has, for example, been produced using the transverse cutting station 16 and transverse welding station 13. Said bag 18 can be made available to the filling unit 40 by means of the grippers 17. In that context, the bag 18 first of all reaches the layer-moving device 30. A retaining device 41 is provided for here, with which the bag 18 can be—or is—held. In the embodiment shown, the retaining device 41 is embodied by two holding bars 42, of which each one is abuts an external wall of the bag. A lever mechanism connected to the machine frame can be provided for, for this purpose, so that an opening and closing movement is enabled. Once the bag 18 is held by the retaining device 41, the grippers 17 can be released from the bag and swing back, in order to pick up the next bag 18.

Preferably at least one fluid nozzle 43 is arranged in the layer-moving device 30, which is preferably fastened to a stationary bar 44. With this fluid nozzle 43, which can be subjected to a fluid that is subject to excess pressure via a fluid duct 45, a fluid is added in the direction of the arrow 46. The fluid, preferably air, directly reaches the upper edge 47 of the bag 18, so that the two layers of the bag can be separated from one another. Consequently, one layer of the bag is moved in relation to a second layer. The bag 18 is, in particular, at least partially open, which is actually shown in FIG. 2. In order to continue to produce the relative movement of the layers of the bag 18, as an alternative, or in addition to the fluid nozzle, suction cups 48 are provided for, which are arranged above the retaining device, i.e. running counter to the direction z, and can likewise be made to abut a respective external wall of the bag from the outside. Each suction cup 48, is, for that purpose, arranged on a support 49, wherein the support can be arranged in such a way that it is stationary or can be movable in relation to the machine frame, for instance via a lever mechanism, which is, however, not shown. The suction cups 48 can, alternatively, be arranged on holding jaws 42 of the retaining device 41, so that the suction cups already abut the outside of the bag, if the holding jaws have been closed. Since it can be provided for that the suction cups 48 only perform a small stroke movement, the latter can be designed as bellows suction cups or as wave bellows suction cups, as is also shown in FIG. 2. The functioning is as follows: Once the suction cup 48 abuts the external wall of the bag 18, it is subjected to negative pressure via the vacuum duct 50. Once the external layer has been made to abut the suction cup 48, so that no air is sucked through between these two elements, the negative pressure which continues to exist causes the suction cup to retract, so that the external wall or the layer concerned is moved. It is important for the supports to remain in a fixed position during this procedure, i.e. not undertake any movement in order to open the bag. Since this procedure is done with both layers of the bag, the two layers are, in this way, separated from one another. Should fluid meanwhile continue to enter through the fluid nozzle 43, a relative movement of the layers of the bag occurs not only in the area of the suction cups, but also in the area between the suction cups 48 and the retaining device 41.

It is, moreover, as shown in FIG. 2, advantageous to provide for a device 51 for ionizing the jet of fluid. Two electrodes are provided for, for this purpose, which are arranged on both sides of the jet of fluid, and between which an electric current is applied. In this way, the jet of fluid can be ionized, so that it can reduce electrical charges on the layers of the bag. That leads to the layers being better able to be separated. The electrodes can be arranged in a stationary manner, are, however, preferably directly connected to the fluid nozzle 43.

Once the bag 18 has been opened in the layer-moving device 30, the jet of fluid can be interrupted. A valve 52, with which the jet of fluid can be interrupted, is provided for in the fluid duct 45, for this purpose. The negative pressure, which acts upon the suction cups 49, is interrupted or reduced as well. Once the grippers 19 have gripped the bag 18, the retaining device 41 can be removed from the bag 18. The bag 18 can now be transported to the filling station 20 by the grippers 19, so that conventional suction cups 22, which are arranged on supports 61 that can be moved by means of levers 60, can open the bag 18. Since the layers of the bag 18 in the layer-moving device have already, in sections, been separated from one another or have been moved in relation to one another, the bag is opened, for the purpose of being filled, substantially more reliably. It can, on the other hand, be observed in the prior art that the suction cups 22 lose contact with the bag during the opening procedure, or the two layers cannot be separated from one another, so that the bag ends up not being opened.

Once the bag 18 has been opened, it—and/or the hopper 62 of the filling device 23 can be moved, so that the hopper 62 extends into the interior of the bag 63. The bag can subsequently be filled.

FIG. 3 now shows the III-III view of FIG. 2. Two fluid nozzles 43 can be seen in this figure, which are both arranged on the bar 44, wherein they assume an angle in relation to the direction z. The position of the fluid nozzles can be symbolized by the arrows S. This direction can also be termed the main direction of flow, in regard to which it is, however, stipulated that the jet of fluid is diversified by means of the fluid nozzles, which is in each case shown by multiple arrows 46. The two fluid nozzles are displaced outwardly in relation to the imaginary center line of the bag 18, i.e. in the direction of the vertical bag edges. It is thereby possible to increase the area of influence of the jet of fluid, and even increase it with the area of the center line 64. For the sake of improved clarity, the devices 51 for ionizing the jet of fluid are not shown in FIG. 3. It is, however, to be emphasized that at least one such device 51 is allocated to each fluid nozzle 43.

What is shown, on the other hand, is the holding bars 42 of the retaining device 41. It is, for example, shown that the holding bars 42 do not need to be integral, but may be disconnected, in order to enable the bag material in the central area to engage in an opening movement. In an enhancement, it can, in addition, be provided for that the holding bars are movable in or against the direction y, so that even more scope for movement can be accorded to the material of the bag.

The suction cups 48, of which only one is visible, can also be displaced in relation to the center line 64, which will be explained in more detail based on FIG. 4. In addition, it can be discerned that the suction cups 48 are positioned near the upper edge of the bag 66, or touch it. Overlapping is also possible. That means that the suction cup can partially extend beyond the upper edge of the bag.

FIG. 4 shows the IV-IV view of FIG. 3. A further embodiment can be seen in this view, in which the bag comprises 18 side gussets 65. It can, furthermore, once again be seen that the suction cups 48 can be displaced in the direction of the lateral edges in relation to the center line. This serves the purpose of the suction cups not sucking mutually, for, in this case, the bag could not be opened.

It can, moreover, be seen in FIG. 4 that the fluid nozzles 43 can be twisted around their own longitudinal axis in relation to the plane in the direction R defined by the bag 18. It is thereby achieved that the jet of fluid in any case reaches the edge of the bag 66, even if the fluid nozzle 43 does not point precisely to the plane defined by the bag 18.

Finally, another variant embodiment is shown, based on FIG. 4, where the holding bars 42 are not interrupted, as explained based on FIG. 3, but only have recesses 67, which likewise allow the material of the bag to move. In this representation, the holding bars 42 are shown in the open position, which, however, does not need to be the case. This only serves the purpose of improved clarity here.

Finally, it is to be emphasized that the directions, as well as directional relationships, specified, such as "at the top" or "above", are always to be understood as the regular directions in relation to gravity.

| List of reference signs | |
|---|---|
| 1 | Form fill seal machine, FFS machine |
| 2 | Supporting arm |
| 3 | Winding |
| 4 | Film |
| 5 | Feed roll |
| 6 | Deflection roller |
| 7 | Feed roll |
| 8 8a | Feed roll |
| 9 | Lever |
| 10 | Piston/cylinder unit |
| 11 | |
| 12 | |
| 13 | Transverse welding station |
| 14 | Parallelogram arrangement |
| 15 | Pair of feed rollers |
| 16 | Transverse cutting station |
| 17 | Gripper or grippers |
| 18 | Tube section |
| 19 | Gripper or grippers |
| 20 | Filling station |

-continued

| List of reference signs | |
|---|---|
| 21 | Stationary gripper |
| 22 | Suction cup or cups |
| 23 | Filling device |
| 24 | |
| 25 | |
| 26 | |
| 27 | Bag |
| 28 | |
| 29 | |
| 30 | Layer-moving device |
| 31 | |
| 32 | |
| 33 | Sealing jaw |
| 34 | |
| 35 | |
| 36 | |
| 37 | |
| 38 | |
| 39 | |
| 40 | |
| 41 | Retaining device |
| 42 | Holding bars |
| 43 | Fluid nozzle |
| 44 | Bar |
| 45 | Fluid duct |
| 46 | Diversification of the jet of fluid by means of fluid nozzles |
| 47 | |
| 48 | Suction cup or cups |
| 49 | Suction cup or cups |
| 50 | |
| 51 | Device for ionizing the jet of fluid |
| 52 | Valve |
| 53 | |
| 54 | |
| 55 | |
| 56 | |
| 57 | |
| 58 | |
| 59 | |
| 60 | Lever |
| 61 | Support(s) |
| 62 | Hopper |
| 63 | Interior of the bag |
| 64 | Imaginary center line |
| 65 | Side gussets |
| 66 | Upper edge of the bag |
| 67 | Recess |
| R | Indicates the direction |
| y | Indicates the direction |
| S | Symbolizes the position of the fluid nozzles |

The invention claimed:

1. A filling device for filling bags with a respective unsealed upper end and at least two layers lying on top of one another, the filling device comprising:

a filling station for filling the bags, wherein the filling station comprises suction cups for opening the bag, at least one layer-moving device for moving said at least one layer of the bag in relation to said at least one second layer, with which it is possible to have an impact upon the layers of the bag, wherein the layer-moving device is arranged in front of the filling station, wherein the layer-moving device comprises at least one suction device, which engages with the outside of a layer of the bag, a transport device configured to transport the bag from the layer-moving device to the filling station such that the layers of the bag lie on top of one another, the interior of the bag is free of tools while the bag is being transported, and no fluid or ambient air gets into the interior of the bag, and at least one retaining device with which the bag can be held in the at least one layer-moving device, wherein the retaining device holds the layers of the bag in such a way that they are compressed.

2. The filling device in accordance with claim 1, wherein at least one means of support, to hold a bag in the layer-moving device, is provided for, which remains stationary within the filling device prior to and during the time that the layer-moving device is having an impact, or can be moved within the filling device with a stroke of a maximum of 15 mm.

3. The filling device in accordance with claim 2, wherein the at least one means of support can be moved within the filling device with a stroke of a maximum of 10 mm.

4. The filling device in accordance with claim 1, wherein the layer-moving device comprises at least one fluid nozzle, with which a jet of a fluid can be directed at the top of the bag.

5. The filling device in accordance with claim 4, wherein the fluid is a gas which is subject to excess pressure.

6. The filling device in accordance with claim 5, wherein the gas is air.

7. The filling device in accordance with claim 4, wherein the fluid nozzle is designed in such a way that the jet of fluid is oriented towards a longitudinal axis of the bag.

8. The filling device in accordance with claim 4, wherein at least one electrode is provided for, with which the jet of fluid can be energized with an electric current.

9. The filling device in accordance with claim 8, wherein the electrode is subordinated to the outlet of the fluid nozzle.

10. The filling device in accordance with claim 4, wherein at least one valve is provided for, with which the jet of fluid can be conducted through a source of excess pressure and/or may be interrupted in order to be able to generate a fluid thrust.

11. The filling device in accordance with claim 1, wherein the suction device touches the upper end of the bag or overlaps the upper edge of the bag.

12. The filling device in accordance with claim 1, wherein the layer-moving device comprises at least two suction devices, and at least one suction device in the at least two suction devices is provided for on each side of the bag, wherein the at least two suction devices are offset from one another on the plane of the bag.

13. The filling device in accordance with claim 1, wherein the suction device is a bellows suction cup.

14. The filling device in accordance with claim 1, wherein the suction device is placed on at least one supporting element, in regard to which the supporting element remains fixed within the filling unit while the layer-moving device is in operation.

15. The filling device in accordance with claim 1, wherein the at least one retaining device is configured to grip the bag underneath a suction cup.

16. The filling device in accordance with claim 1, wherein the at least one retaining device is designed in the shape of a bar and includes a gap in the area of a suction cup device and/or at least one recess.

17. A form fill seal device comprising a bag-forming device, with which successive tubular sections made of a tube material, the lower ends of which can each be equipped with a base, can be separated, to form bags that are open at the top;

a filling device for successively filing a product into the bags;

a head or base seam welding station, with which upper openings of the bag can be closed;

retaining devices, with which the bags can be held within at least one of the bag- forming device, the filling device, or the head or base seam welding station;

conveyors, with which the bags can be individually placed between the bag-forming device, the filling device, or the head or base seam welding station, wherein the filling device is designed in accordance with claim 1.

18. A method for filling bags with one respective unsealed upper end and at least two superimposed layers, wherein the filling is done at a filling station comprising suction cups for opening the bag, the method comprising:

exerting an impact upon at least one layer of the bag, using at least one layer-moving device, in order to move said layer in relation to said at least one second layer, wherein the layer-moving device is placed in front of the filling station and the layer-moving device comprises at least one suction device, which engages with the outside of a layer of the bag;

transporting the bag from the layer-moving device to the filling station such that the interior of the bag is free of tools while the bag is being transported and no fluid or ambient air gets into the interior of the bag; and holding the layers of the bag in such a way that they are compressed.

* * * * *